US007357272B2

(12) United States Patent
Maxwell

(10) Patent No.: US 7,357,272 B2
(45) Date of Patent: Apr. 15, 2008

(54) VENTABLE CONTAINER ASSEMBLY

(75) Inventor: Jason R. Maxwell, Elgin, IL (US)

(73) Assignee: The Glad Products Company, Oakland, CA (US)

( * ) Notice: Subject to any disclaimer, the term of this patent is extended or adjusted under 35 U.S.C. 154(b) by 548 days.

(21) Appl. No.: 10/880,788

(22) Filed: Jun. 30, 2004

(65) Prior Publication Data

US 2006/0000842 A1 Jan. 5, 2006

(51) Int. Cl.
*B65D 51/16* (2006.01)
*B65D 41/18* (2006.01)

(52) U.S. Cl. ..... 220/785; 220/780; 220/4.21; 220/366.1

(58) Field of Classification Search ..... 220/367.1, 220/780, 4.24, 4.21, 785, 366.1
See application file for complete search history.

(56) References Cited

U.S. PATENT DOCUMENTS 3,516,572 A * 6/1970 Davis ..... 220/781
3,797,694 A 3/1974 See et al.
3,876,130 A 4/1975 Haase
4,024,980 A * 5/1977 Kneusel et al. ..... 220/260
4,390,113 A 6/1983 Bird
5,356,026 A 10/1994 Andress et al.
5,377,860 A 1/1995 Littlejohn et al.
6,047,851 A 4/2000 Freek et al.
6,056,138 A 5/2000 Chen
6,170,696 B1 1/2001 Tucker et al.
6,196,404 B1 3/2001 Chen
7,063,231 B2 * 6/2006 Stanos et al. ..... 220/793
7,090,090 B2 * 8/2006 Ohyama ..... 220/366.1
7,097,063 B2 * 8/2006 Tucker et al. ..... 220/366.1
7,097,066 B2 * 8/2006 Tucker et al. ..... 220/793

FOREIGN PATENT DOCUMENTS

JP 03200574 A * 9/1991
WO WO 2004/113198 A1 12/2004

* cited by examiner

*Primary Examiner*—Anthony D. Stashick
*Assistant Examiner*—James Smalley
(74) *Attorney, Agent, or Firm*—Thomas C. Feix

(57) ABSTRACT

A ventable container comprising a container bottom having an inner cavity, the container bottom further having a side wall that terminates in a container rim; and a selectively detachable lid, the lid including a central panel and peripheral sealing lip that surrounds the panel, the peripheral sealing lip having a generally inverted U-shaped cross-section that defines a lid channel, the lid channel being adapted to receive the container rim, the lid channel being further adapted to position the lid at a first position wherein sealed engagement of the container is effectuated and at a first position relative to the container rim wherein an air passage from the inner cavity to the container surroundings is provided.

7 Claims, 6 Drawing Sheets

VENTABLE CONTAINER ASSEMBLY

FIELD OF THE PRESENT INVENTION

The present invention relates generally to reclosable containers. More particularly, the invention relates to a detachable container lid that selectively provides venting for a container when attached thereto.

BACKGROUND OF THE INVENTION

Thermoplastic containers are well known in the art. The noted containers generally include a lid that is selectively detachable from a bowl (or container bottom) and are commonly designed to provide a variety of features, including being reusable, disposable, microwavable, and the like.

Numerous types of container assemblies and means for effecting sealable engagement of a lid on a bowl have been devised. Illustrative are the containers and engagement means disclosed in U.S. Pat. No. 6,170,696.

One problem that is associated with a conventional, microwavable container stems from the rapid temperature changes that it must endure. The container must be permitted to vent during microwaving due to the high pressures that arise as moisture in the container contents vaporizes and gas temperatures increase. Thus, the container must be left open to some degree during microwaving. However, it is also desirable to keep the bowl covered as much as possible to prevent the contents from splattering the inside of the microwave.

A further problem that is often encountered with thermoformed containers is the ability to accommodate produce respiration while maintaining the sealed integrity of the container. As is well known in the art, providing adequate venting (or breathing rate(s)) to accommodate produce respiration can, and in most instances will, enhance produce freshness.

Various methods and container designs have been employed to provide adequate venting of a container during and after microwaving, and to accommodate produce respiration. One common practice is to remove the lid and place it loosely over the container bowl to accommodate produce respiration and, during microwaving, to allow air and steam to escape. Another common practice is to only partially remove the lid (i.e., "crack open" the lid) by disengaging only part of the lid from the bowl.

Both of the noted practices generally accommodate produce respiration. However, in both instances, the container is subject to leaking, i.e., no longer leak-proof.

The noted practices also permit sufficient air and steam to vent during microwaving because the increased pressure within the container will tend to force the container open, increasing any space between the lid and the bowl. However, once microwaving is complete, the steam will cool and the pressure in the container will drop significantly. Because the pressure differential no longer tends to open the container, the above-noted venting practices often do not permit sufficient air to vent back into the container to compensate for the pressure drop. This problem can be aggravated by the accumulation of steam or vapor, which can form a vapor seal between the lid and bowl. A vacuum can result, which can permanently damage the container.

Various container designs have been employed to provide venting. For example, in U.S. Pat. No. 3,362,565 a lid is disclosed that includes a sidewall, which has a sealing bead near the base and a shoulder near the top. The sealing bead seals against an internal shoulder provided in a container.

Notches are intermittently disposed about an outer periphery of the sealing bead. These notches provide a venting passageway through which gases generated in a sealed container can escape when the gas or vapor pressure is sufficient to flex the lid upward at its center, causing a fulcruming action.

In U.S. Pat. No. 5,147,059 a lid is disclosed having a series of vent-defining protuberances on the inner surface of a vertical, outer sealing portion of a lid. The protuberances engage a container rim to permit venting when the lid is loosely placed on the container. The venting prevents internal/external pressure differentials that might resist the proper seating and removal of the lid.

One commercial product, i.e., Tupperware® Fridgesmart™ container, includes two (2) push button vents in the bowl that are adapted to accommodate produce respiration.

There are several drawbacks and disadvantages associated with prior art container venting means. A major drawback is that the prior art venting means typically include complex design features that are difficult to manufacture. Lids employing the complex design features are thus quite costly.

It would thus be advantageous to provide a ventable container lid having effective, easy to use venting means (i) that is adapted to effectuate sealable engagement of the lid and a container bottom in a first position and provide an effective air passage when the venting means is in a second position and (ii) can be readily manufactured via a conventional thermoforming process.

SUMMARY OF THE INVENTION

In accordance with one embodiment of the invention, disclosed herein is a ventable container having a lid and a bottom, the bottom including an inner cavity and a side wall that terminates in a rim, the lid including a central panel and a peripheral sealing lip that surrounds the panel, the peripheral sealing lip having a generally inverted U-shaped cross section that defines a lid channel, the lid channel being adapted to receive the container rim, the lid channel including a transition region adapted to position the lid at a first position relative to the container rim wherein the lid and bottom are tightly occluded to prevent liquid leakage and a second position relative to the container rim wherein an air passage is provided, the lid channel further including a positioning region adapted to position the lid in the second position.

In a preferred embodiment of the invention, the lid positioning region is further adapted to releasably secure the lid in the second position.

Preferably, the lid transition region is in communication with the lid positioning region.

Preferably, the lid positioning region extends around the lid sealing lip.

In one embodiment of the invention, the lid positioning region is substantially continuous.

In another embodiment of the invention, the lid positioning region is discontinuous.

In accordance with a further embodiment of the invention, disclosed herein is a ventable container having a lid and a bottom, the bottom including an inner cavity and a side wall that terminates in a rim, the lid including a central panel and a peripheral sealing lip that surrounds the panel, the peripheral sealing lip having a generally inverted U-shaped cross section that defines a lid channel, the sealing lip including a lid stop, the lid channel being adapted to receive the container rim, the lid channel being further adapted to position the lid at a first position relative to the container rim wherein the lid and bottom are tightly occluded to prevent liquid leakage and a second position relative to the container rim wherein an air passage is provided, the lid stop being adapted to communicate with the container rim when the lid is in the second position, whereby the lid is releasably secured in the second position.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Before describing the present invention in detail, it is to be understood that this invention is not limited to particularly exemplified container lid designs, configurations or sizes, materials and methods as such may, of course, vary. Thus, although a number of container lid designs and configurations similar or equivalent to those described herein can be used in the practice of the present invention, the preferred container lid designs and configurations are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patent and patent applications cited herein, whether supra or infra, are hereby incorporated by reference in their entirety.

Finally, as used in this specification and the appended claims, the singular forms "a "an" and "the" include plural referents unless the content clearly dictates otherwise. Thus, for example, reference to "an air flow path" includes two or more such paths.

The present invention substantially reduces or eliminates the disadvantages and drawbacks associated with prior art container bowl and lid assemblies. As discussed in detail herein, the container lid of the invention includes highly effective, simple to operate venting means. According to the invention, during microwaving, the venting means permits air and steam to vent from the inner volume of the container and also permits sufficient air to vent back into the container lid after microwaving (i.e., cooling) to compensate for the pressure drop. The venting means also accommodates produce respiration.

Figure 1:
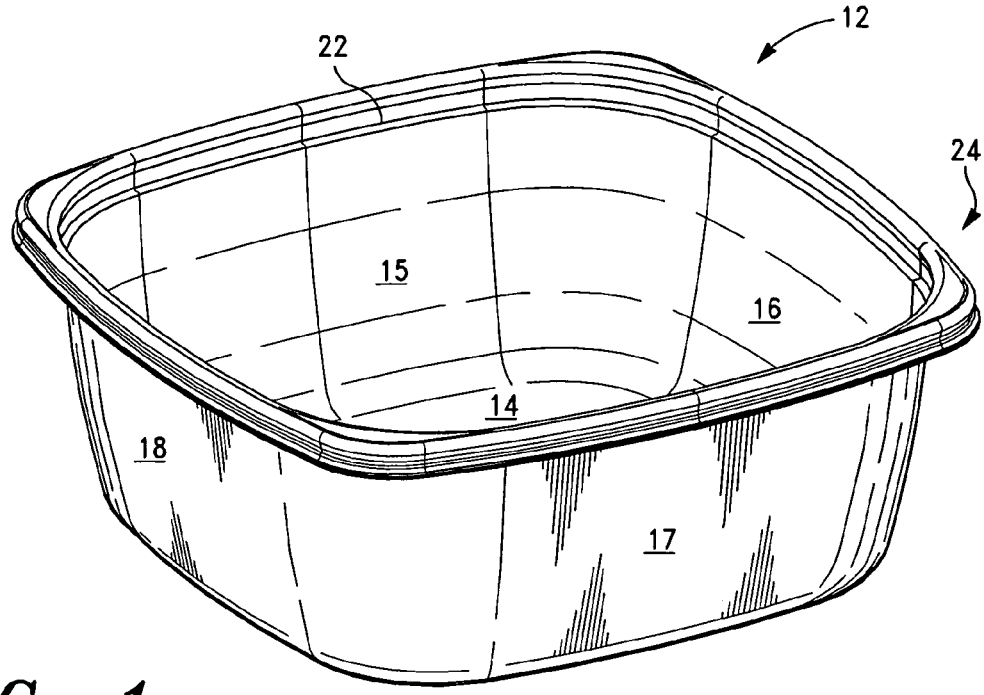
FIG.—1 (PRIOR ART)
FIG. 1 is a top perspective view of a prior art container bottom.
Figure 3:
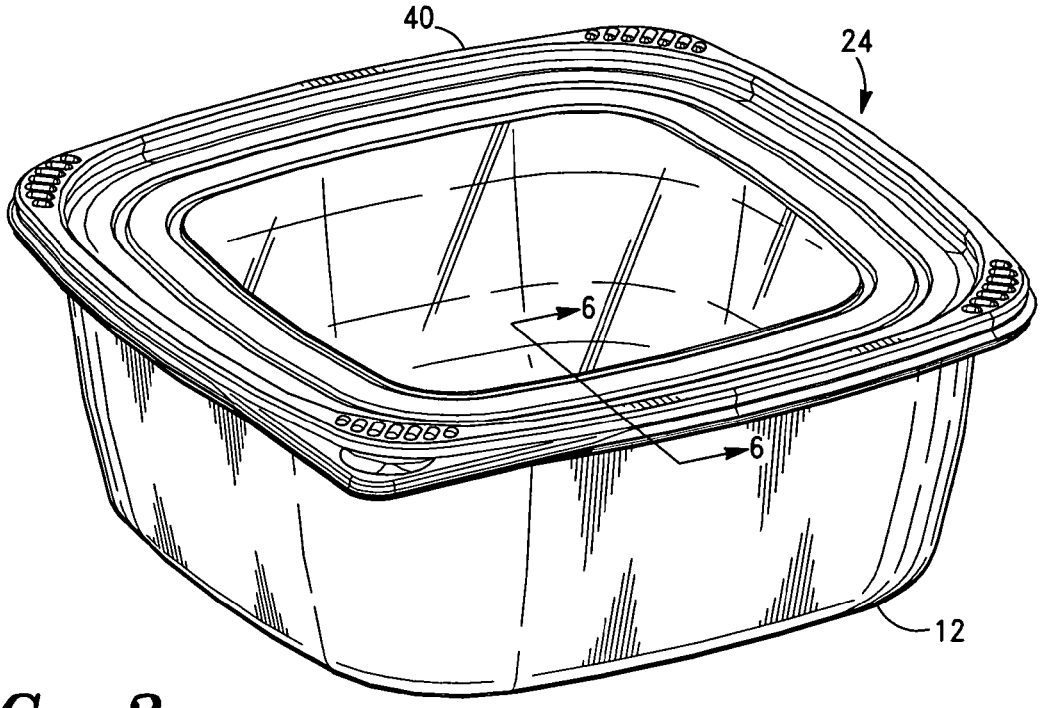
FIG.–3 (PRIOR ART)
FIG. 3 is a perspective view of a prior art container lid and bottom assembly.
Figure 4:
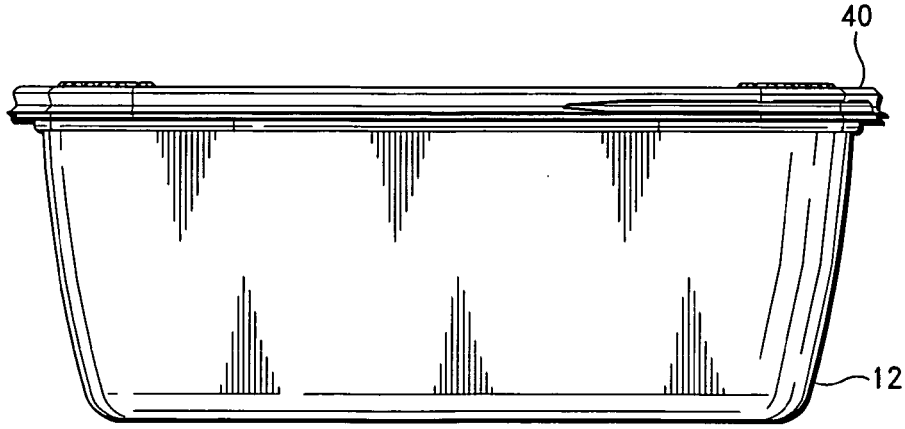
FIG.–4 (PRIOR ART)
FIG. 4 is a side elevation view of the container assembly shown in FIG. 3.

Referring first to FIG. 1, there is shown a conventional container bottom 12, which is sealably closed by a flexible container lid 40 (see FIGS. 3 and 4). As illustrated in FIG. 1, the container bottom 12, has a bottom surface 14, four sidewalls 15, 16, 17, 18, a denesting shoulder 22, and a closure device (or rim) 24. The bottom surface 14 provides a stacking recess (not shown) extending upwardly to a substantially horizontal central panel surface (also not shown).

The sidewalls 15, 16, 17, 18 extend upwardly and slightly outwardly from the periphery of the bottom surface 14. At the termination of the sidewalls 15, 16, 17, 18 an outwardly and substantially horizontally extending denesting shoulder 22 is provided, which merges into the base of the closure device 24. The terms "inwardly" and "outwardly" are used herein with respect to the reference line 100 and moving in a clockwise direction 101, as shown in FIGS. 5 and 6.

Figure 5:
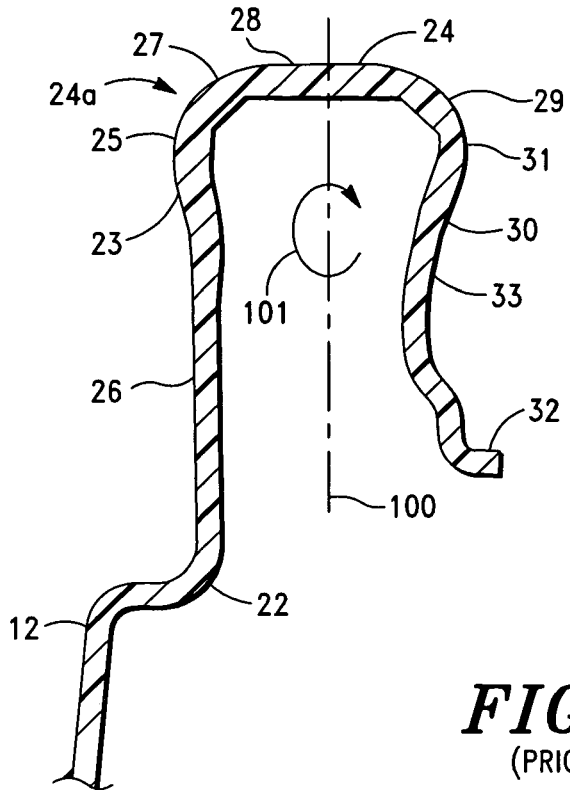
FIG.–5 (PRIOR ART)
FIG. 5 is a partial side elevation view of a prior art container bottom closure device.
Figure 6:
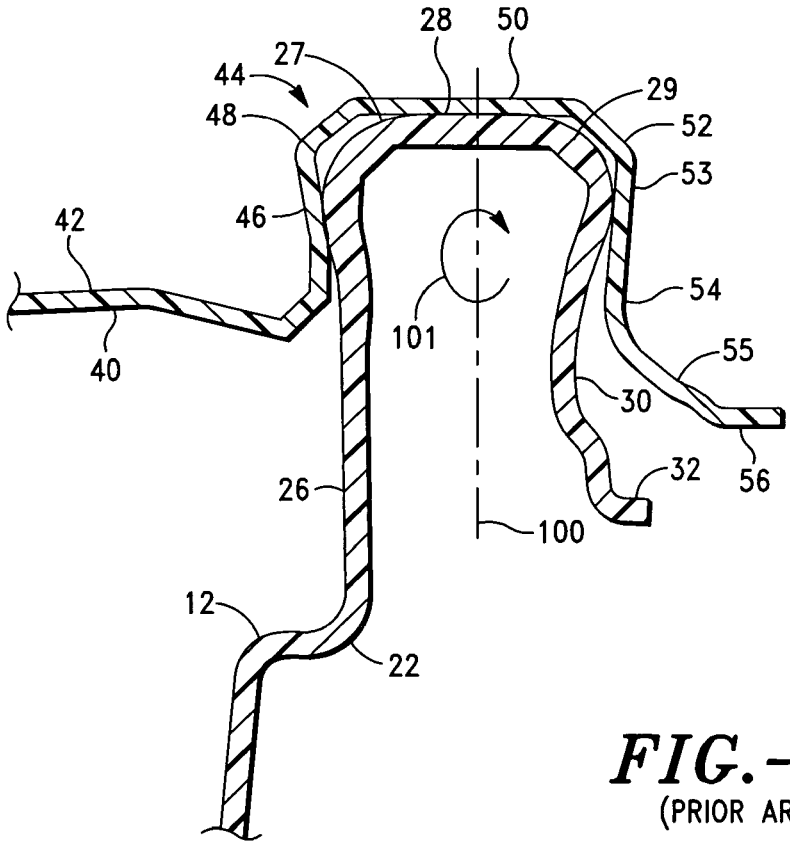
FIG.–6 (PRIOR ART)
FIG. 6 is a cross sectional view of an engaged prior art lid and container bottom taken along line 6-6 of FIG. 3.

Referring to FIG. 5, the closure device 24 includes an inner sealing wall 26, a retention bead 24*a*, an outer wall 30 and a skirt 32. The sealing wall 26 preferably extends from the denesting shoulder 22 and merges into the retention bead 24*a*.

The retention bead 24*a* can include at least one upwardly and outwardly extending undercut or cut-back portion 23, an inner vertical portion 25, an upwardly and inwardly extending lead-in portion 27, a horizontal rim surface 28, a downwardly and outwardly extending lead-in portion 29, an outer vertical portion 31, and a downwardly and inwardly extending undercut or cut-back portion 33.

Figure 2:
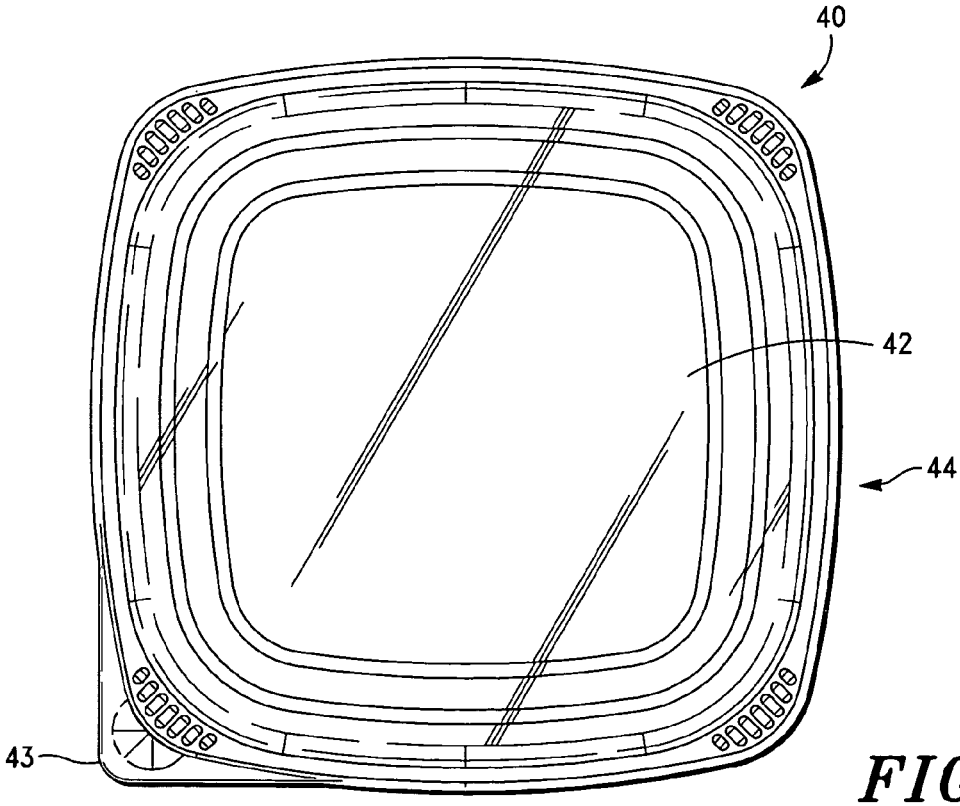
FIG.—2 (PRIOR ART)
FIG. 2 is a top plan view of a prior art container lid adapted to sealably engage the container bottom shown in FIG. 1.

Referring now to FIG. 2, there is shown a container lid 40 that is adapted to sealingly engage the container bottom 12, as discussed above. As illustrated in FIG. 2, the container lid 40 generally includes a central panel 42, a gripping tab 43 and a peripheral sealing lip or closure device 44 that is adapted to sealingly engage the closure device 24 of the container bottom 12.

Referring now to FIG. 6, the closure device 44 extends from the central panel 42 and has a generally inverted U-shaped cross section. As illustrated in FIG. 6, the closure device 44 includes an inner wall 46 that extends upwardly and inwardly from the panel 42, an upwardly and outwardly extending inner nesting portion 48, a horizontal rim surface 50, a downwardly and outwardly extending outer nesting portion 52, a downwardly and inwardly extending undercut or cut-back portion 53, a outer vertical portion 54 a downwardly and outwardly extending lead-in portion 55, and a substantially horizontal lip 56.

When the lid 40 is secured to the container bottom 12, undercut 23 engages undercut 46 to provide a first inside peripheral seal and undercut 30 engages undercut 53 to provide a second outer peripheral seal. Hence, the closure device of sealing lip 44 of the lid 40 acts as a sealing channel to receive the closure device (or rim) 24 of the container bottom 12.

Further details of the container lid 40 and bottom 12 are set forth in U.S. Pat. No. 6,170,696 B1, which is incorporated herein in its entirety.

Figure 7:
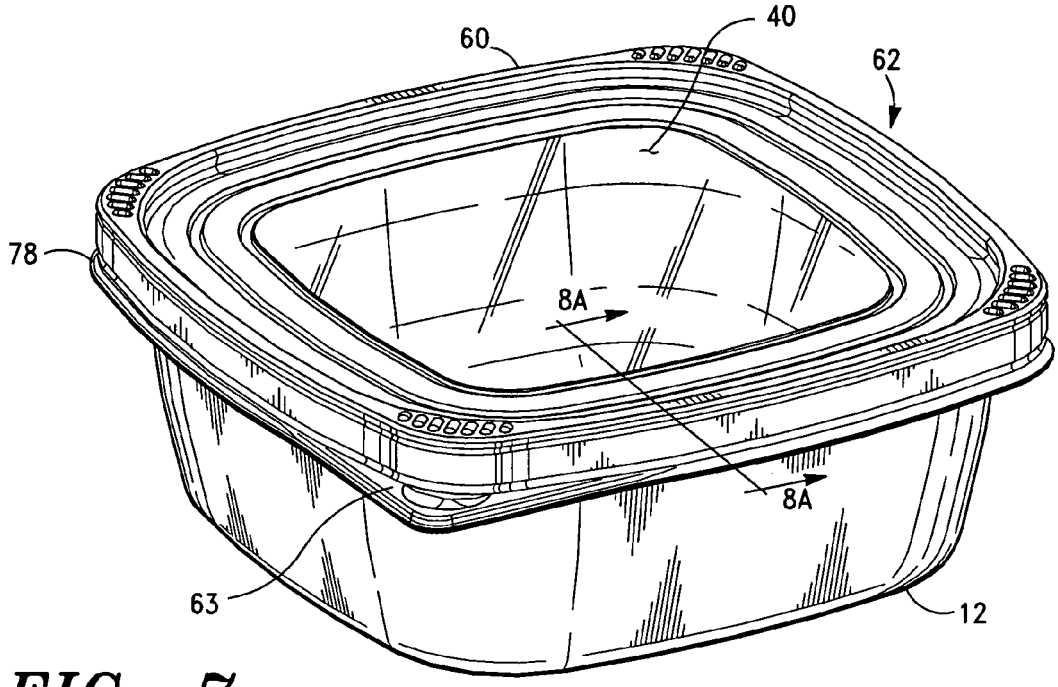
FIG. 7 is a perspective view of a ventable container lid and bottom assembly, according to one embodiment of the invention.
Figure 8A:
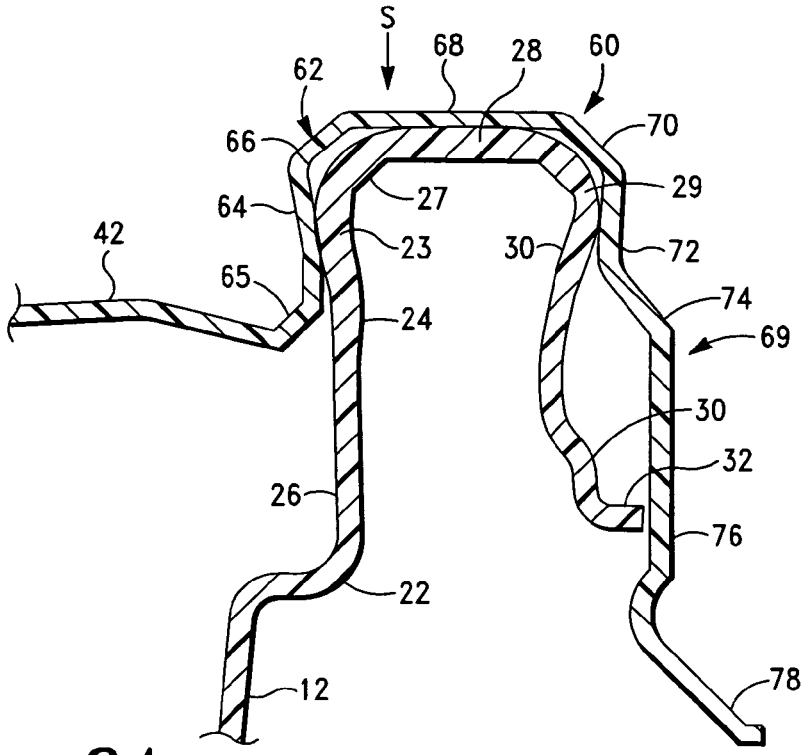
FIG. 8A is a cross sectional view of the engaged ventable container lid and bottom taken along line 8A-8A of FIG. 7, illustrating a first position of the lid relative to the container bottom, according to the invention.
Figure 8B:
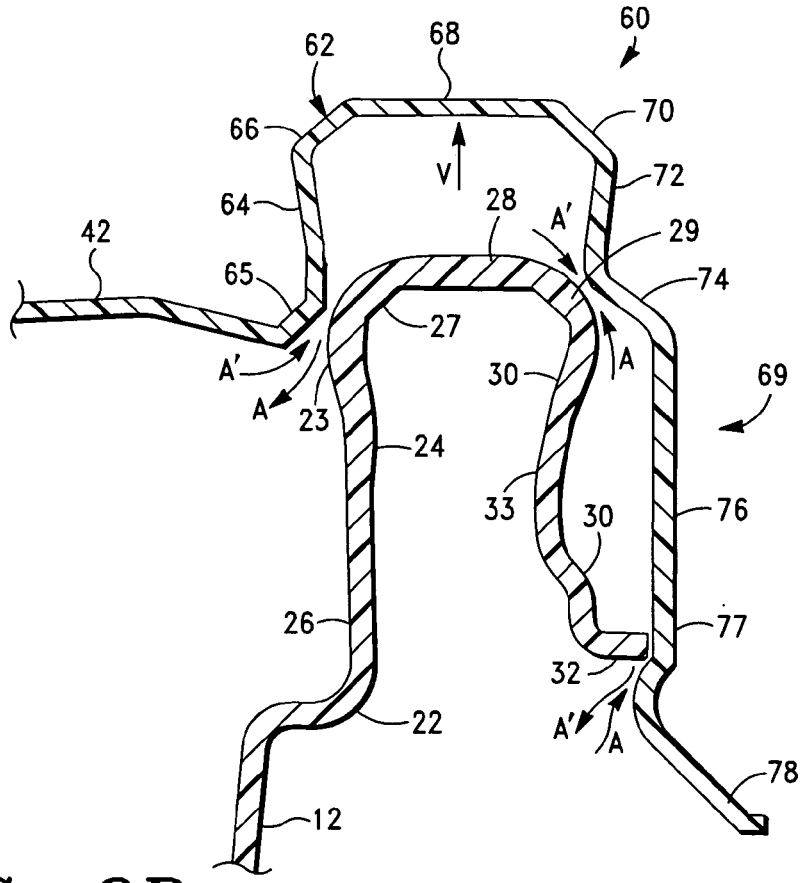
FIG. 8B is further cross sectional view of the engaged ventable container lid and bottom shown in FIG. 8A, illustrating a second position of the lid relative to the container bottom, according to the invention.

Referring now to FIGS. 7, 8A and 8B, there is shown one embodiment of the ventable container lid and bottom of the invention. Although the invention is described with respect to a substantially square lid and container assembly (i.e., where the closure portions are generally square in top profile view), it is to be understood that the venting means of the invention can be employed on virtually any size and shape lid and container assemblies, including but not limited to lid and container assemblies having round, rectangular and/or complex curve profile configurations.

As will further be appreciated by one having ordinary skill in the art, numerous suitable materials may be chosen to fabricate the ventable container lid of the invention. Preferably, the container lid and container bottom are made from a resilient polymeric material suitable for both freezing and microwave reheating.

Referring now to FIG. 7, there is shown a perspective view of one embodiment of a ventable container lid 60 of the invention positioned on (or engaged to) a conventional container bottom 12. For purposes of clarity, all reference numerals used to describe the various elements of the conventional container bottom 12 depicted in FIGS. 1-6 are carried over in the description of the embodiments of the present invention shown and described in FIGS. 7 to 10B infra. As illustrated in FIG. 7, the lid 60 similarly includes a central panel 42 and a peripheral sealing lip or closure device 62. The closure device 62 further includes a downwardly extended skirt 78 and a gripping tab 63.

Referring now to FIG. 8A, the lid closure device 62 has a generally inverted U-shaped cross section and includes an upwardly and outwardly extending transition or lead-in portion 65, an inner wall or undercut 64 that extends inwardly and upwardly from the lead-in portion 65 and an upwardly extending inner nesting portion 66. The closure device 62 further includes a horizontal rim section 68, a downwardly and outwardly extending outer nesting portion 70, a downwardly and inwardly extending cut-back portion or undercut 72 and a downwardly and outwardly extending lead-in portion 74.

The outermost wall portion of the lid closure device 62 (generally designated by reference numeral 69) further includes a downwardly extending lid transition region 76, an outwardly extending skirt 78 and an undercut region 77 disposed therebetween. As discussed in detail below, the undercut region 77 functions as a container lid locking device to hold the lid 60' in place when moved in a second position relative to the container bottom 12 (i.e., venting position), as shown in FIG. 8B.

As illustrated in FIGS. 8A and 8B, the lid closure device 62 of the present invention is similarly adapted to receive and sealingly engaged the closure device 24 of the container bottom 12. Referring now to FIG. 8A, there is shown a first position of the lid 60 relative to the container bottom 12, which is achieved by exerting a closure force on the lid 60 in the direction denoted by Arrow S. According to the invention, when the lid 60 is in the noted first position, sealed engagement of the container lid 60 to the container bottom 12 is effectuated. In this embodiment, a first inner seal is formed by the engagement between inside undercut 23 of the container bottom closure device 24 and inside undercut 64 of the lid closure device 62 and a second outer seal is formed by the engagement between outside undercut 30 of the container bottom closure device 24 and outside undercut 72 of the lid closure device 62.

Referring now to FIG. 8B, there is shown a second position of the lid 60 relative to the container bottom 12, which is achieved by raising the lid 60 in the direction denoted by Arrow V. According to the invention, when the lid 60 is in the noted second position, an air passage through the closure region (designated by Arrows A, A') is provided.

As stated, when the lid 60 is raised in the direction denoted by Arrow V, the lid stop or undercut region 77 of the sealing lip 62 contacts the skirt 32 of the container bottom closure 24 to position and retain the lid 60 in the noted second position. The lid transition region 76 of outer wall 69 is of sufficient length to permit lead-in portions 65 and 74 to rest loosely on top of respective lead-in portions 27 and 27 of the container bottom closure device 24 and to permit venting through the closure region in the second venting position. To fully remove the lid 60, the user simply applies additional lifting force to the lid pull tab (not shown) in order to move the lid stop or undercut 77 out of locking engagement with the container bottom closure device 24. Alternately, the user may "pop" the lid off by placing a finger or thumb under the skirt 78 to outwardly flexing the skirt 78 and release the undercut 77 from locking engagement with the skirt 32 of the container bottom closure device 24. It is understood that thermoformed containers can be formed to provide a desired amount of flexibility and elastic memory to permit repeated flexures to fully open the container lid from the container bottom and still retain desired seal integrity when the lid is moved back into the first sealed engagement position.

The lid 60 is loosely positioned on the container bottom 12 when in the noted second, venting position. To fully remove the lid 60 from the container bottom 12 the user simply continues raising the lid in the direction of Arrow V to move the undercut region 77 beyond its engagement with the skirt 32. Depending on the dimensions selected for the length of the lid transition region 76 and inward relief of undercut region 77, one or more regions of air tight contact can be realized. Such contact seal regions may be useful in certain applications such as microwave cooking wherein controlled steam venting is desirable. As internal steam pressure builds within the confined space of the container, the contact seal regions, being relatively weak, allow for controlled release of pressurized steam through the closure. The controlled release of steam substantially eliminates the high pressure conditions that cause the lid to blow off and the cooked food to splatter from the confined space of the container to the inside walls of the microwave oven.

Figure 9:
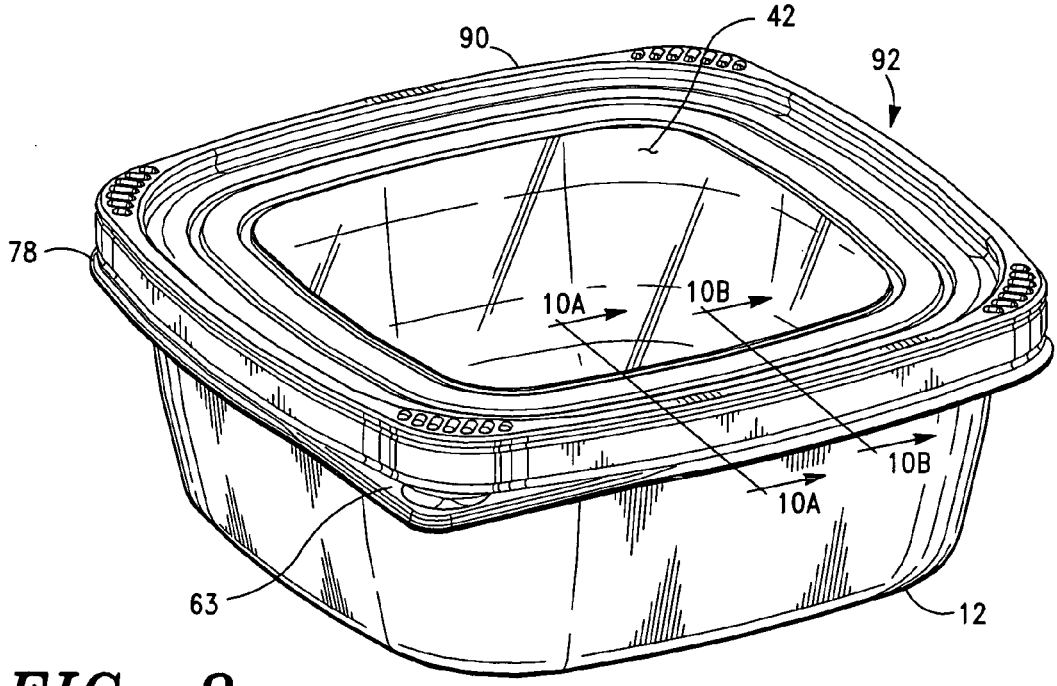
FIG. 9 is a perspective view of a ventable container lid and bottom assembly, according to another embodiment of the invention.

Referring now to FIG. 9, there is shown a perspective view of another embodiment of a ventable container lid 90 of the invention positioned on a conventional container bottom 12. As illustrated in FIG. 9, the lid 90 similarly includes a central panel 42, a peripheral sealing lip or closure device 92, a downwardly extended skirt 78 and a gripping tab 63.

Figure 10A:
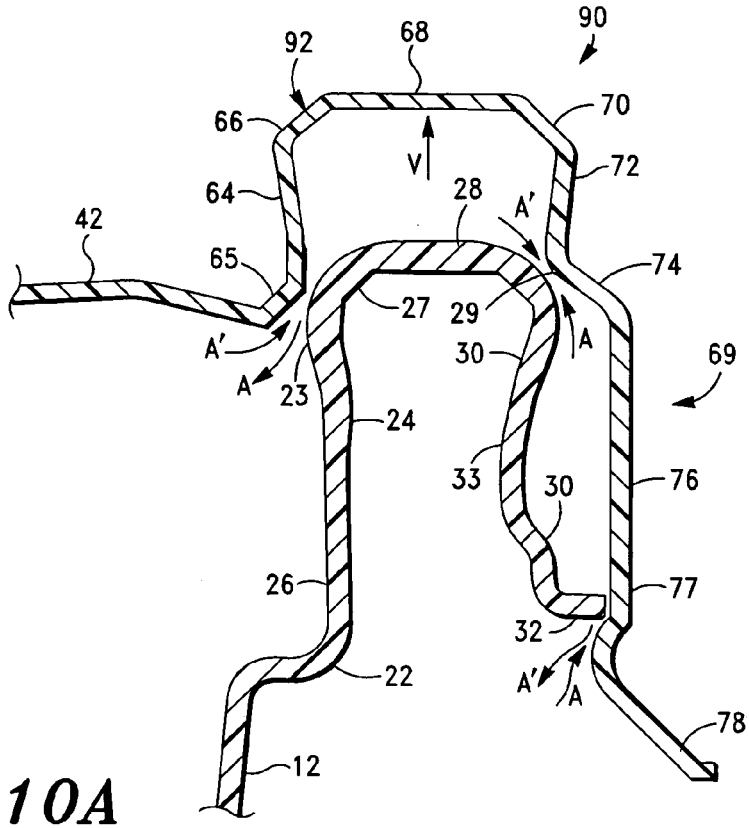
FIG. 10A is a cross sectional view of the engaged ventable container lid and bottom taken along line 10A-10A of FIG. 9.
Figure 10B:
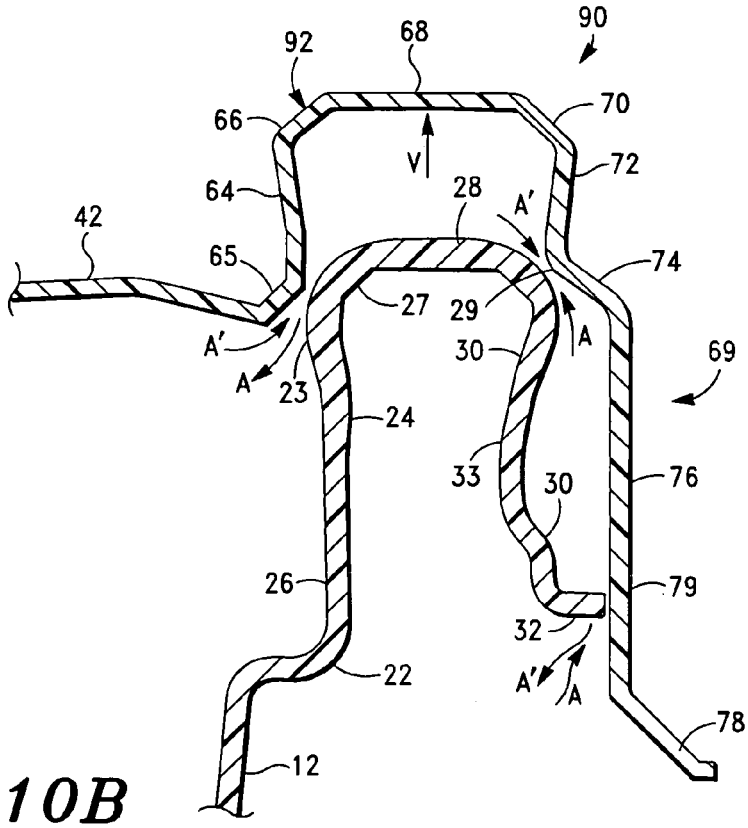
FIG. 10B is a cross sectional view of the engaged ventable container lid and bottom taken along line 10B-10B of FIG. 9.

Referring now to FIG. 10A, the closure device 92 of lid 90 is substantially similar to the closure device 62 of lid 60, discussed above. However, as illustrated in FIG. 10B, in this embodiment, the undercut region 77 of the lid 90 is discontinuous to enhance the air flow into and out of the container cavity. The enhance airflow afforded by this embodiment is suitable for refrigerated storage of high respiring produce.

According to the invention, the discontinuity can comprise one or more opens 79 in the undercut region 77, which can have various sizes and spacing to achieve the desired air flow.

As will be appreciated by one having ordinary skill in the art, the ventable container lids of the invention and, hence, container assemblies employing same readily accommodate produce respiration when the produce is disposed therein. The container assemblies also provide an effective air passage during and after microwaving to accommodate pressure differentials between the container cavity and the container surroundings.

Without departing from the spirit and scope of this invention, one of ordinary skill can make various changes and modifications to the invention to adapt it to various usages and conditions. For example, while the present invention has been illustrated in the context of a particular type of sealing container having both inside and outside sealing regions that are formed by the engagement of mating inside and outside undercuts between the lid and container bottom closures, it is understood that other closure configurations for the lid and container bottom are possible such as a container bottom closure with only one under cut as disclosed in U.S. Pat. No. 6,032,827. As such, these changes and modifications are properly, equitably, and intended to be, within the full range of equivalence of the following claims.

What is claimed is:

1. A ventable container assembly, comprising:

a container bottom having an inner cavity, said container bottom further having a side wall that terminates in a first closure portion defining a container rim;

a container lid including a central panel and a second closure portion that surrounds said panel, said second closure portion having a generally inverted U-shaped cross-section that defines a channel having inner and outer channel walls, said outer channel wall having a downwardly extending lid transition region and an undercut region;

said container lid is movable between a first, sealed position relative to said container bottom in which said container rim of said container bottom is received by said inner and outer channels walls of said channel and a second, venting position relative to said container bottom in which said inner and outer channel walls are disposed above said container rim to permit venting of gases from within said inner cavity and to ambient atmosphere; and said undercut region engages said container rim and secures said container lid to said container bottom when said container lid is moved into said second, venting position.

2. The ventable container assembly of claim 1, wherein at least one of said inner and outer channel walls includes an undercut portion.

3. The ventable container assembly of claim 1, wherein said undercut region is substantially continuous about a periphery of said second closure portion.

4. The ventable container assembly of claim 1, wherein said undercut region is discontinuous about a periphery of said second closure portion.

5. A microwavable container assembly, comprising:

a container bottom having an inner cavity, said container bottom further having a side wall that terminates in a first closure portion defining a container rim;

a container lid including a central panel and a second closure portion that surrounds said panel, said second closure portion having a generally inverted U-shaped cross-section that defines a channel having inner and outer channel walls, said outer channel wall having a downwardly extending lid transition region and an undercut region;

said container lid is movable between a first, sealed position relative to said container bottom in which said container rim of said container bottom is received by said inner and outer channels walls of said channel and a second, controlled venting position relative to said container bottom in which said inner and outer channel walls are disposed above and in loose contact with said container rim;

said undercut region engages said container rim and secures said container lid to said container bottom forming a peripheral contact seal and when said container lid is moved into said second, controlled venting position, and said peripheral contact seal being sufficiently weak to permit controlled venting there through of steam pressure build up generated inside said cavity during microwave cooking of food.

6. The microwavable container assembly of claim 5, wherein at least one of said inner and outer channel walls includes an undercut portion.

7. The microwavable container assembly of claim 5, wherein said undercut region is substantially continuous about a periphery of said second closure portion.

* * * * *